US010953957B2

(12) United States Patent
Tian

(10) Patent No.: US 10,953,957 B2
(45) Date of Patent: Mar. 23, 2021

(54) PROPELLING MODULE AND SURFING APPARATUS HAVING THE SAME

(71) Applicant: YUJET INTERNATIONAL CORPORATION LIMITED, Central (HK)

(72) Inventor: Yu Tian, Hong Kong (HK)

(73) Assignee: YUJET INTERNATIONAL CORPORATION LIMITED, Hong Kong (CN)

( * ) Notice: Subject to any disclaimer, the term of this patent is extended or adjusted under 35 U.S.C. 154(b) by 146 days.

(21) Appl. No.: 16/033,077

(22) Filed: Jul. 11, 2018

(65) Prior Publication Data

US 2019/0308696 A1 Oct. 10, 2019

(30) Foreign Application Priority Data

Apr. 10, 2018 (CN) ..... 201810316266.5

(51) Int. Cl.
*B63B 32/10* (2020.01)
*B63B 32/00* (2020.01)
(Continued)

(52) U.S. Cl.
CPC ..... *B63B 32/10* (2020.02); *B63B 32/00* (2020.02); *B63H 21/17* (2013.01); *B63H 2011/081* (2013.01)

(58) Field of Classification Search
CPC ..... B63B 32/10; B63B 32/00; B63B 34/00; B63B 34/15; B63B 34/20; B63H 21/17;
(Continued)

(56) References Cited

U.S. PATENT DOCUMENTS 4,811,682 A * 3/1989 Hwang ..... B63B 7/087 114/345
6,409,560 B1 * 6/2002 Austin ..... B63B 32/10 441/74
(Continued)

FOREIGN PATENT DOCUMENTS

JP 06171583 A * 6/1994
JP 08239090 A * 9/1996
(Continued)

*Primary Examiner* — Ajay Vasudeva
(74) *Attorney, Agent, or Firm* — WPAT Law, P.C.; Anthony King

(57) ABSTRACT

Disclosed are a propelling module and a surfing apparatus having the same. The propelling module includes a module housing, a rotating device, a transmission shaft and a propeller; wherein the module housing is provided with a sealed chamber, the propeller is arranged outside the sealed chamber, the rotating device is arranged inside the sealed chamber, one end of the transmission shaft is connected to the rotating device, the other end of the transmission shaft penetrates through a side wall of the sealed chamber and extends to the exterior of the sealed chamber, and is connected to the propeller; the module housing is provided with a power connection member, and the rotating device is electrically connected to the power connection member, and is configured to be electrically connected to an external device via the power connection member; and the module housing is further provided with a water passage, and the propeller is arranged in the water passage.

11 Claims, 5 Drawing Sheets

(51) Int. Cl.
*B63H 21/17* (2006.01)
*B63H 11/08* (2006.01)

(58) Field of Classification Search
CPC ..... B63H 5/07; B63H 2011/081; B63H 2021/171
See application file for complete search history.

(56) References Cited

U.S. PATENT DOCUMENTS

| | | | | |
|---|---|---|---|---|
| 6,966,808 | B1 * | 11/2005 | Liao | B63B 32/10 441/74 |
| 7,930,985 | B2 * | 4/2011 | Walworth | B63H 11/04 114/55.58 |
| 8,398,446 | B2 * | 3/2013 | Railey | B63H 21/17 441/74 |
| 10,358,192 | B2 * | 7/2019 | Sitar | B63H 16/04 |
| 2001/0042498 | A1 * | 11/2001 | Burnham | B63B 32/10 114/55.56 |
| 2011/0201238 | A1 * | 8/2011 | Rott | B63H 11/08 440/6 |

FOREIGN PATENT DOCUMENTS

| | | | | |
|---|---|---|---|---|
| JP | 2002193185 | A * | 7/2002 | |
| WO | WO-2018149044 | A1 * | 8/2018 | B63B 35/7913 |

* cited by examiner

PROPELLING MODULE AND SURFING APPARATUS HAVING THE SAME

CROSS-REFERENCE TO RELATED APPLICATIONS

This application claims foreign priority to China Pat. Application No. 201810316266.5 filed on Apr. 10, 2018, now pending, which is hereby incorporated by reference in their entirety.

TECHNICAL FIELD

The present disclosure relates to the technical field of water sports, and in particular, relates to a propelling module and a surfing apparatus having the same.

BACKGROUND

Surfing sports are well populated among people because of adventure and benefits to health. Common surfboards may be used only under assistance of the pushing force of wind waves. When there is not wind wave or the wind wave is tiny, the surfboards may not be well used. With conventional electric surfboards, surfers may surf as they desire even when there is no wind wave or the wind wave is tiny. The electric surfboard has the advantages of good mobility, flexibility, environmental-friendliness and the like, and thus surfing has become a water leisure and entertainment sport welcomed among people.

An electric surfboard mainly includes a surfboard body, a power-supplying battery, a motor, a control device and a main tailpiece; wherein the power-supplying battery, the motor and a part of the control device all need to be mounted in a hollow chamber of the surfboard body, thus, the lines in the hollow chamber are very complicated and easily damageable. Consequently, the electric surfboard is damaged generally due to the problem of the motor and the control device in the hollow chamber, in addition, the motor and the control device in the hollow chamber need to be repaired by professionals with skills. As such, users have to transport the entire surfboards to the manufacturers for repair. After having repaired the surfboards, the manufacturers need to transport the entire electric surfboards back to the users. The electric surfboard has a very large size, and thus the repair and transportation are complicated, and the transportation cost is high.

SUMMARY

To overcome the defects that the line of the conventional surfboard is very complicated and easily damageable, the repair and transportation are complicated, the transportation cost is high and the like in the prior art, the present disclosure provides a propelling module and a surfing apparatus having the same.

According to the present disclosure, the above technical problem is solved by using the following technical solutions:

A propelling module is provided. The propelling module includes: a module housing, a rotating device, a transmission shaft and a propeller; wherein the module housing is provided with a sealed chamber, the propeller is arranged outside the sealed chamber, the rotating device is arranged inside the sealed chamber, one end of the transmission shaft is connected to the rotating device, the other end of the transmission shaft penetrates through a side wall of the sealed chamber and extends to the exterior of the sealed chamber, and the other end of the transmission shaft is connected to the propeller;

the module housing is provided with a power connection member, the rotating device is electrically connected to the power connection member, and the rotating device is configured to be electrically connected to an external device via the power connection member; and two ends of the module housing are respectively provided with a storage end and a tail end, the sealed chamber is arranged at the storage end, the module housing is further provided with a water passage, wherein the water passage penetrates through from a bottom surface of the tail end to a side surface of the tail end, and the propeller is arranged in the water passage.

In this technical solution, by virtue of the above structure, rotating device is arranged in the sealed chamber, which effectively prevents external water and impurities from contacting the rotating device, and improves the safety and reliability of the rotating device.

In addition, the rotating device is conveniently connected to the external device via the power connection member, which is simple and causes no damages, and greatly reduces the maintenance workload.

Meanwhile, by arranging the propeller in the water passage, the propelling force may be effectively increased, the propelling speed of the propelling module is improved, and the effect of energy saving is achieved.

Optionally, the rotating device is electrically connected to an external battery module via the power connection member.

In this technical solution, by virtue of the above structure, the rotating device is connected to the external battery module via the power connection member. As such, the external battery module is capable of conveniently supplying power to the rotating device.

Optionally, the power connection member comprises a connection tube and a connection joint; wherein the connection tube upwardly extends from a top surface at a top portion of the module housing along a vertical direction and the connection tube is in communication with the sealed chamber, the connection joint is sealingly connected in the connection tube and the rotating device is electrically connected to the connection joint, and the connection joint is electrically connected to the external battery module.

In this technical solution, by virtue of the above structure, the connection tube upwardly protrudes along the vertical direction, such that the power connection member and the external battery module are connected in an insertion manner, which facilitates the connection and improves the connection precision.

In addition, the connection joint and the connection tube are sealingly connected, which effectively prevents the external water and impurities from entering the sealed chamber. Meanwhile, by virtue of the connection joint, the power connection member is conveniently connected to the battery module via the connection joint.

Optionally, the rotating device includes a control assembly and a motor; wherein the control assembly includes a brushless motor controller, an input of the brushless motor controller is electrically connected to the power connection member, an output of the brushless motor controller is electrically connected to the motor, and the transmission shaft is connected to a rotor of the motor.

In this technical solution, by virtue of the above structure, an external direct current flows through the power connection member to the input of the brushless motor controller, and the direct current is converted into an alternating current. Afterwards, the alternating current flows through the output of the brushless motor controller to the motor, such that the motor operates.

In addition, the transmission shaft is driven to rotate by means of the rotor of the motor. The operation is reliable, and the use and control are convenient.

Optionally, the control assembly further includes a governor, and the module housing is further provided with a control connection member; wherein an input of the governor is electrically connected to an external control device via the control connection member, and an output of the governor is electrically connected to the motor.

In this technical solution, by virtue of the above structure, the governor is connected to the external control device in a wired manner, and the control connection portion facilitates the connection. In this way, no damage is caused, and the maintenance workload is greatly reduced. Meanwhile, the governor has a high speed adjustment efficiency and a wide speed governor range.

Optionally, the control assembly further includes a governor; wherein an input of the governor is provided with a signal receiving unit, the signal receiving unit being configured to receive an instruction signal sent by an external control device, and an output of the governor is electrically connected to the motor.

In this technical solution, by virtue of the above structure, the governor is connected to the external control device in a wireless manner, which is convenient, flexible and easy to control. Meanwhile, the governor has a high speed adjustment efficiency and a wide speed governor range.

Optionally, the control assembly is connected to a top portion of the sealed chamber, and the control assembly is arranged above the transmission shaft.

In this technical solution, by virtue of the above structure, the control assembly is arranged above the transmission shaft, such that a small space is occupied. As such, the propelling module is small in size and easy to transport, thereby greatly reducing transport and repair costs.

Optionally, the module housing includes an upper cover and a lower housing; wherein the upper cover is connected to a top surface of the lower housing, the sealed chamber is defined between the upper cover and the lower housing, and a sealer ring is arranged between the upper cover and the lower housing.

In this technical solution, by virtue of the above structure, the upper cover and the lower housing facilitate loading and unloading of the rotating device in the sealed chamber.

In addition, the sealing ring effectively enhances the sealing performance between the upper cover and the lower housing.

Optionally, the motor is connected to the interior of the housing, the control assembly is connected to the upper cover, and the control assembly and the motor are connected via a line joint.

In this technical solution, by virtue of the above structure, the line joint facilitates connection between the control assembly and the motor, and facilitates loading and unloading of the propelling module, thereby improving the repair efficiency.

Optionally, a coupling is arranged between the rotating device and the transmission shaft, the coupling including a first rotating shaft and a second rotating shaft having the same rotation axial line; wherein one side of the first rotating shaft is connected to the transmission shaft and the other side of the first rotating shaft is provided with at least one protrusion, one side of the second rotating shaft is connected to the rotating device and the other side of the second rotating shaft is arranged to be opposite to the other side of the first rotating shaft, and the other side of the second rotating shaft is provided with at least one groove, the protrusion being inserted into the groove.

In this technical solution, by virtue of the above structure, the coupling effectively enhances mounting precision between the rotating device and the transmission shaft, and facilitates mounting of the transmission shaft.

Optionally, an elastic member is pressed between an outer side wall of the protrusion and an inner side wall of the groove.

In this technical solution, by virtue of the above structure, the elastic member achieves the effects of buffering and shock absorption.

Optionally, the module housing is further provided with a water inlet and a water outlet, wherein the water inlet and the water outlet are both in communication with the sealed chamber; the propelling module further comprises a cooling tube, wherein one end of the cooling tube is connected to the tail end and is in communication with the water passage, the cooling tube passes through the water inlet and penetrates through the rotating device, and the other end of the cooling tube passes through the water outlet and is arranged outside the sealed chamber;

wherein module housing is further provided with a tube groove, and the cooling tube is arranged in the tube groove.

A surfing apparatus is further provided. The surfing apparatus includes: a surfboard, a battery module and a propelling module as described above; wherein the battery module is connected to the surfboard, and the propelling module is detachably connected to the surfboard.

In this technical solution, by virtue of the above structure, the propelling module is detachably connected, such that when the propelling module is to be repaired, the propelling module only needs to be transported to the manufacturer. The propelling module is small in structure, and is easy to transport, thereby greatly reduces the transportation and repair costs.

The above preferred conditions may be randomly combined based on the common knowledge in the art, and thus various preferred embodiments of the present disclosure may be derived.

The benefits of the present disclosure lie in that:

With the propelling module and the surfing apparatus having the same according to the present disclosure, the rotating device is arranged in the sealed chamber, such that safety and reliability of the rotating device are improved. As such, the rotating device is conveniently connected to an external device via the power connection member, which is simple and causes no damages. In addition, the propelling module is small in size and easy to transport, thereby greatly reducing transport and repair costs.

Figure 1:
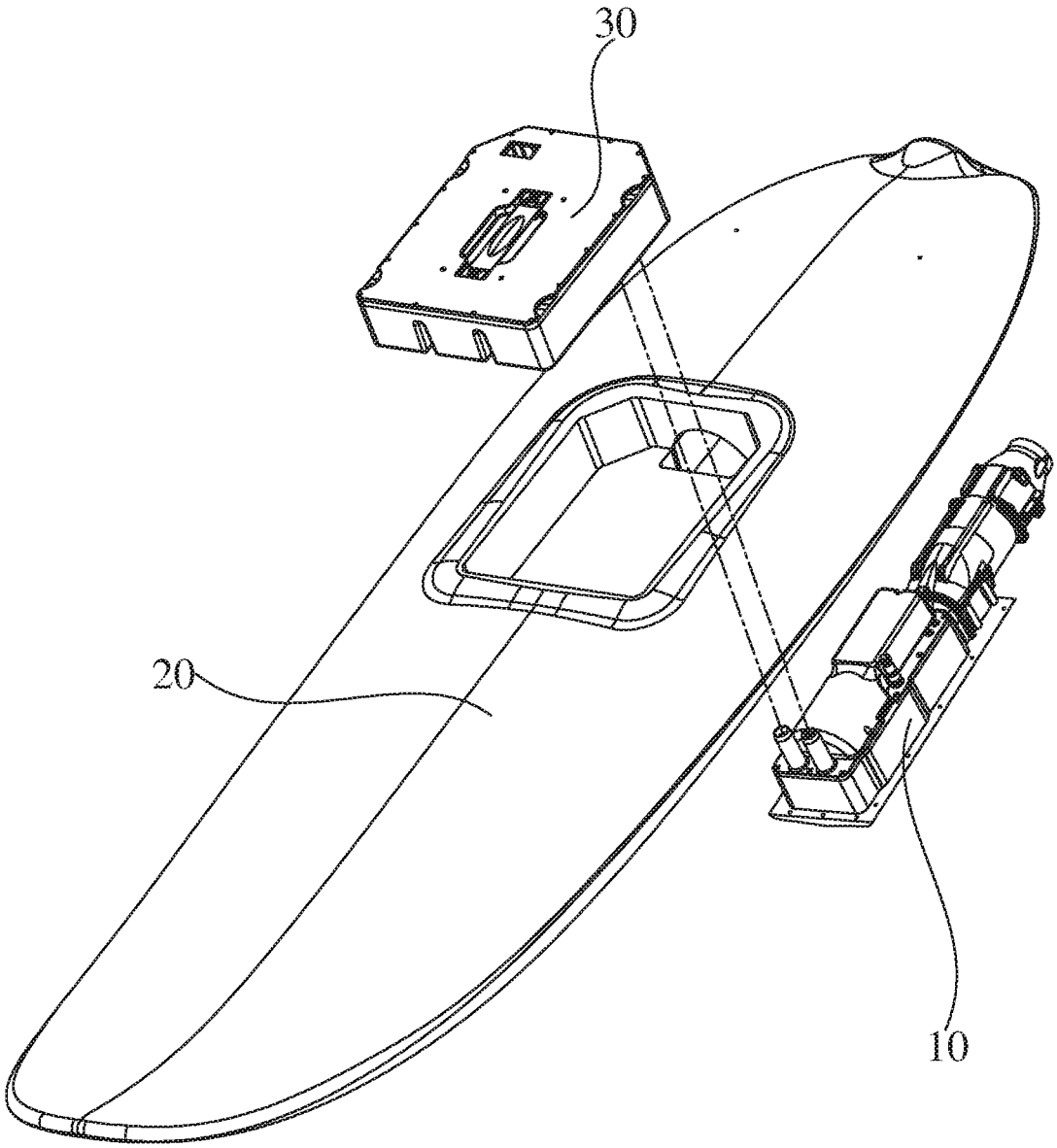
FIG. 1 is a schematic exploded structural diagram of a surfing apparatus according to an embodiment of the present disclosure.

Reference numerals and denotations thereof:

Module housing 1,
Sealed chamber 11,
Power connection member 12,
Connection tube 121,
Connection joint 122,
Control connection member 13,
Lower housing 14,
Storage end 141,
Tail end 142,
Water passage 143,
Upper cover 15,
Water inlet 16,
Water outlet 17,
Tube groove 18,
Rotating device 2,
Control assembly 21,
Motor 22,
Transmission shaft 3,
Propeller 4,
Coupling 5,
First rotating shaft 51,
Protrusion 511,
Second rotating shaft 52,
Groove 521
Cooling tube 6
Propelling module 10
Surfboard 20
Battery module 30

DETAILED DESCRIPTION

Hereinafter the present disclosure is more clearly and completely described with reference to the accompanying drawings and the embodiments. However, the present disclosure is not limited to the scope as defined by the embodiments described.

Figure 2:
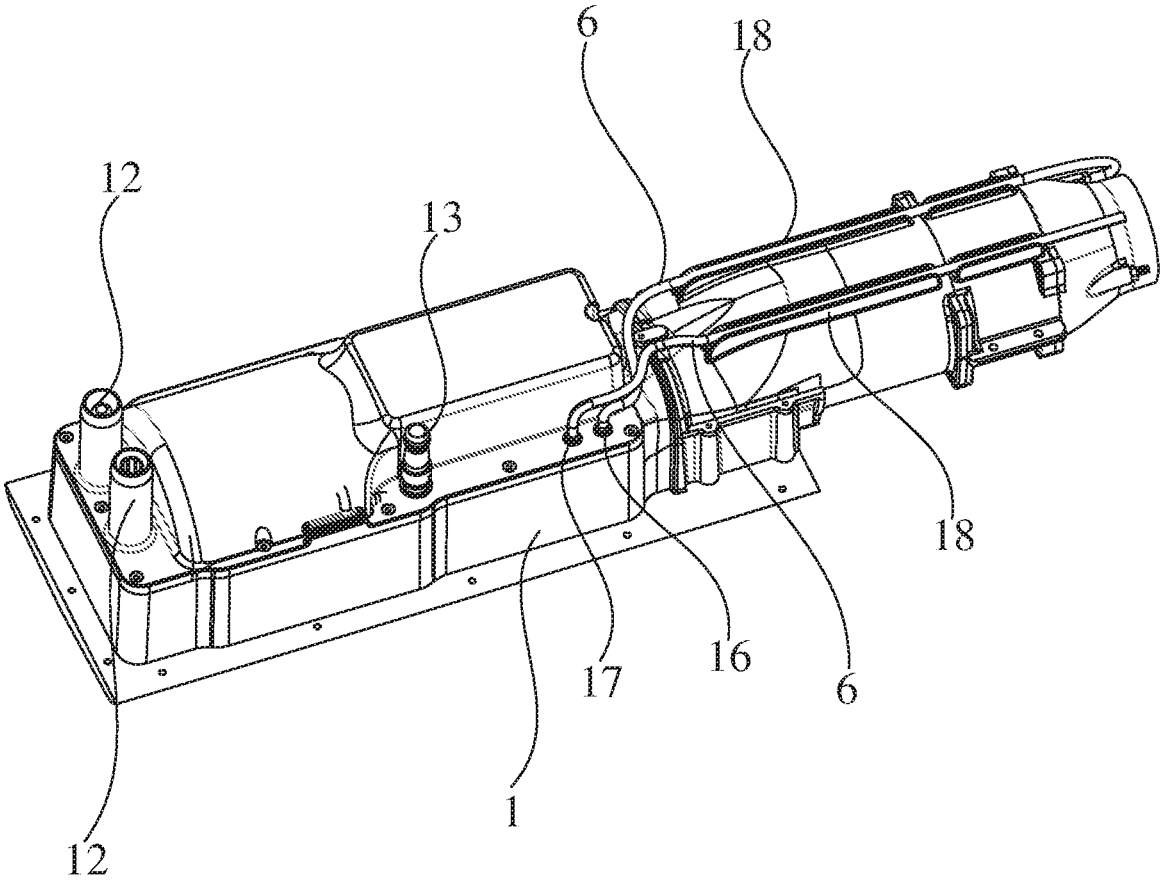
FIG. 2 is a schematic structural diagram of a propelling module of the surfing apparatus according to an embodiment of the present disclosure.
Figure 3:
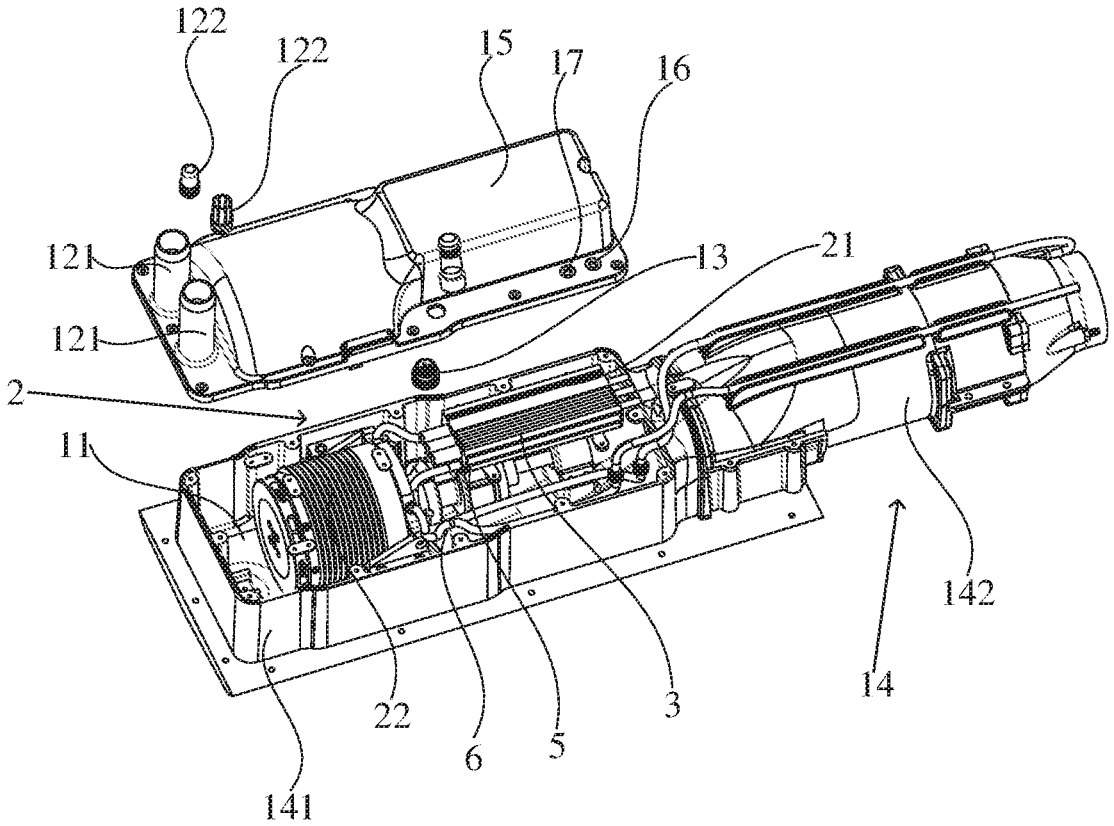
FIG. 3 is a schematic exploded structural diagram of the propelling module of the surfing apparatus according to an embodiment of the present disclosure.
Figure 4:
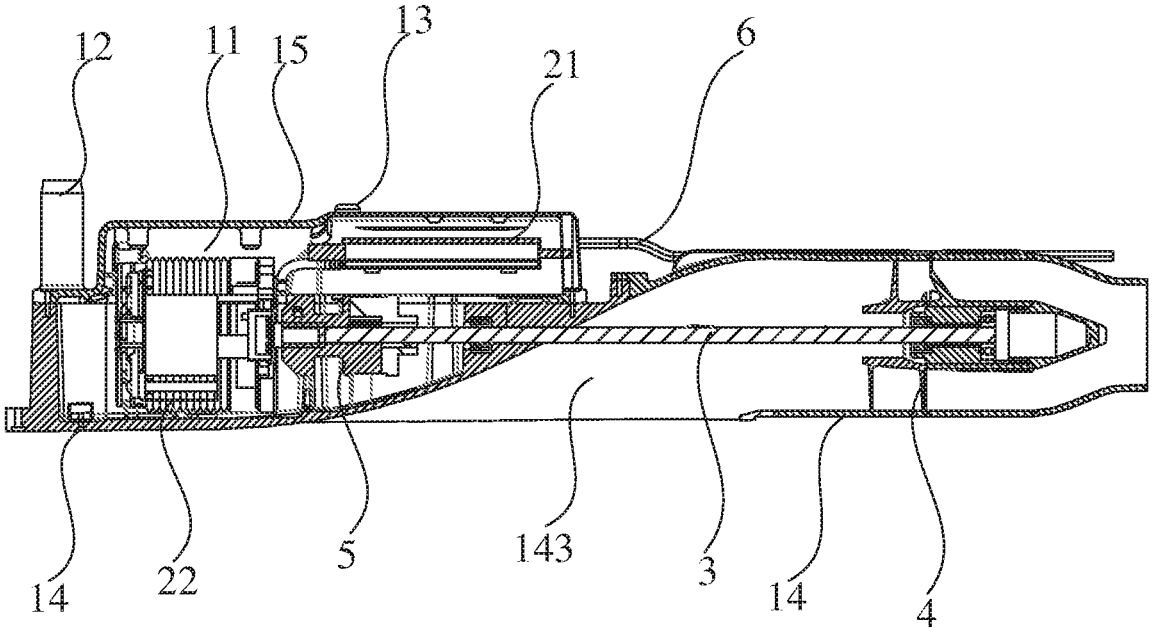
FIG. 4 is a schematic inner structural diagram of the propelling module of the surfing apparatus according to an embodiment of the present disclosure.
Figure 5:
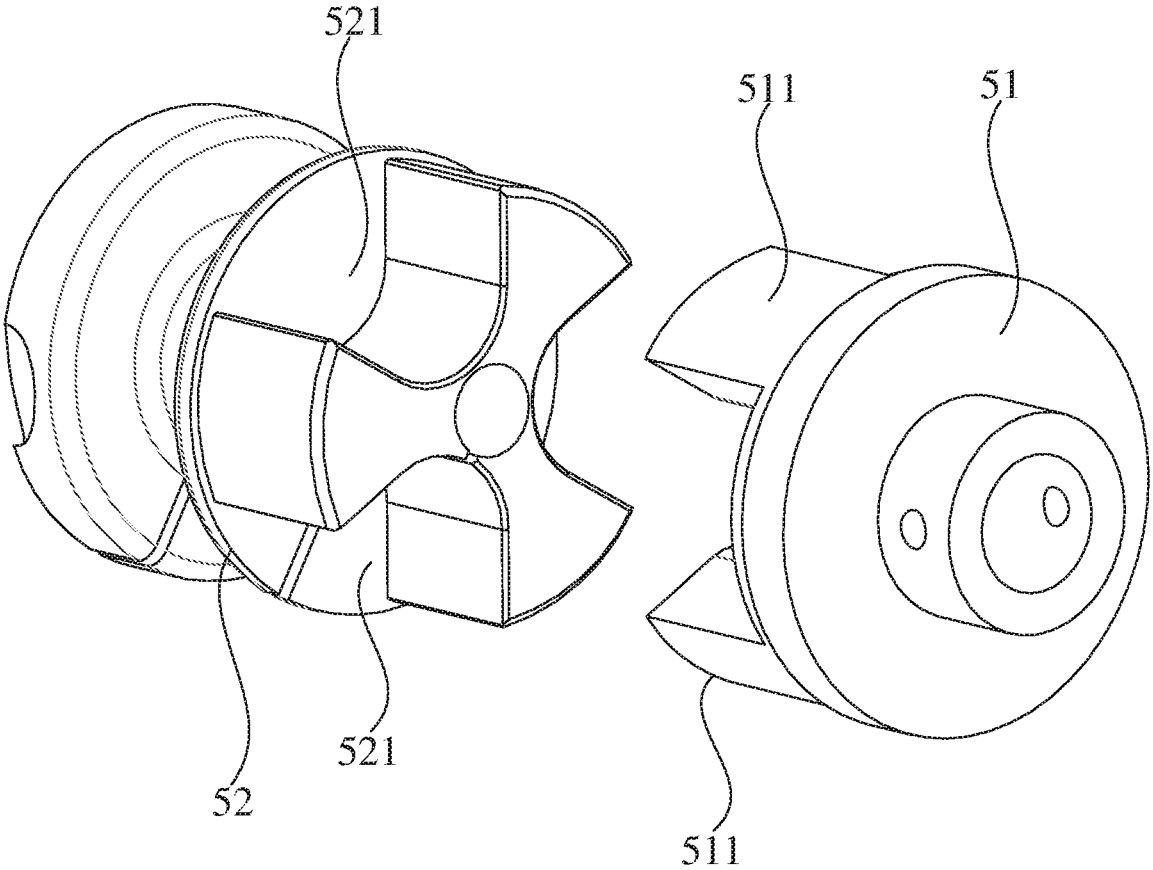
FIG. 5 is a schematic exploded structural diagram of a coupling of the propelling module of the surfing apparatus according to an embodiment of the present disclosure.

As illustrated in FIG. 1 to FIG. 5, a surfing apparatus according to an embodiment of the present disclosure includes a propelling module 10, a surfboard 20 and a battery module 30; wherein the battery module 30 is connected to the surfboard 20, and the propelling module 10 is detachably connected to the surfboard 20. Since the propelling module 10 is detachably connected to the surfboard 20, even if the propelling module 10 fails, the propelling module 10 may still be detached from the surfboard 20 and mailed or transported to the manufacturer for repair. The entire structure of the propelling module 10 is far smaller than the structure of the surfboard 20, such that mailing or transportation of the propelling module 10 is convenient, and the repair cost is greatly lowered.

The propelling module 10 includes a module housing 1, a rotating device 2, a transmission shaft 3 and a propeller 4; wherein the module housing 1 has a sealed chamber 11, the propeller 4 is arranged outside the sealed chamber 11, the rotating device 2 is arranged inside the sealed chamber 11, one end of the transmission shaft 3 is connected to the rotating device 2, the other end of the transmission shaft 3 passes through a side wall of the sealed chamber 11 and extends to the exterior of the sealed chamber 11, and the other end of the transmission shaft 3 is connected to the propeller 4. By virtue of the rotating device 2, the transmission shaft 3 is capable of rotating and driving the propeller 4 to rotate. By means of rotation of the propeller, the propelling module 10 is propelled and moves. In addition, the rotating device 2 is arranged inside the sealed chamber 11, which effectively prevents external water and impurities from being in contact with the rotating device 2, and improves safety and reliability of the rotating device 2.

The module housing 1 is provided with a power connection member 12, the rotating device 2 is electrically connected to the power connection member 12, and the rotating device 2 is electrically connected to an external device via the power connection member 12. The rotating device 2 is conveniently connected to an external device via the power connection member 12, which is simple and causes no damages, and greatly reduces the maintenance workload. The rotating device 2 may be electrically connected to the battery module 30 via the power connection member 12, The rotating device 2 is connected to the external battery module 30 via the power connection member 12, such that the external battery module 30 supplies power to the rotating device 2, and the rotating device 2 converts the electrical energy into mechanical energy and drives the transmission shaft 3 to rotate.

Two ends of the module housing 1 are respectively provided with a storage end 141 and a tail end 142, the sealed chamber 11 is arranged at the storage end 141, the module housing 1 may be provided with a water passage 143, wherein the water passage 143 penetrates through from a bottom surface of the tail end 142 to a side surface of the tail end 142, and the propeller 4 is arranged in the water passage 143. By arranging the propeller 4 in the water passage 143, the propelling force may be effectively increased, the propelling speed of the propelling module 10 is improved, and the effect of energy saving is achieved.

The power connection member 12 may include a connection tube 121 and a connection joint 122; wherein the connection tube 121 upwardly extends from a top surface at a top portion of the module housing 1 along a vertical direction and the connection tube 121 is in communication with the sealed chamber 11. The connection tube 121 upwardly protrudes along the vertical direction, such that the power connection member 12 and the external battery module 30 are connected in an insertion manner, which facilitates the connection and improves the connection precision.

The connection joint 122 is sealingly connected to the connection tube 121, the rotating device 2 is electrically connected to the connection joint 122, and the connection joint 122 is electrically connected to the external battery module 30. The connection joint 122 and the connection tube 121 are sealingly connected, which effectively prevents the external water and impurities from entering the sealed chamber. Meanwhile, by virtue of the connection joint, the power connection member 122 is conveniently connected to the battery module 30 via the connection joint. Optionally, the connection joint 122 is sealingly connected inside the connection tube 121 by means of glue feeding. Two power connection members 12 may be used, and the two connection joints 122 may include a copper male joint and a copper female joint; wherein the copper male joint and the copper female joint may be respectively configured to be connected to a live wire and a neutral wire of the battery module 30.

The rotating device 2 may include a control assembly 21 and a motor 22; wherein the control assembly 21 may include a brushless motor controller, wherein an input of the brushless motor controller is electrically connected to the power connection member 12, and an output of the brushless motor controller is electrically connected to the motor 22. The battery module 30 generally supplies direct current, whereas the motor 22 needs alternating current to operate. Therefore, the direct current of the battery module 30 flows to the input of the brushless motor controller through the power connection member 12, and is converted into the alternating current via the brushless motor controller. Afterwards, the alternating current flows inside the motor 22 through the output of the brushless motor controller, such that by means of the brushless motor controller, the motor 22 is capable of operating.

The transmission shaft 3 may be connected to the rotor of the motor 22. The transmission shaft 3 is driven to rotate by means of the rotor of the motor 22. The operation is reliable, and the use and control are convenient.

The control assembly 21 may further include a governor, wherein the governor may be connected to an external control device (not shown in the drawings) in a wired manner or a wireless manner. When the governor is connected to the external control device in the wired manner, the module housing 1 may be provided with a control connection member 13; wherein an input of the governor is electrically connected to the control device arranged outside the sealed chamber 11 via the control connection member 13, and an output of the governor is electrically connected to the motor 22. The control device arranged outside the sealed chamber 11 sends an instruction signal, wherein the instruction signal is transmitted to the input of the governor via the connection control member 13. The governor is capable of controlling the motor 22 and controlling power of the motor 22 via the output of the governor, such that the rotation speed of the rotor of the motor 22 is controlled. In this way, the propelling speed of the propelling module 10 is controlled. The governor is connected to the control device arranged outside the sealed chamber 11 in a wired manner, and the connection is facilitated via the control connection member 13, which is simple and causes no damages, and greatly reduces the maintenance workload. Meanwhile, the governor has a high speed adjustment efficiency and a wide speed governor range.

When the governor is connected to the control device in a wireless manner, the input of the governor may be provided with a signal receiving unit (not shown in the drawings), wherein the signal receiving unit is configured to receive the instruction signal sent by the control device arranged outside the sealed chamber 11; and the output of the governor is electrically connected to the motor 22. The control device arranged outside the sealed chamber 11 may send the instruction signal via a signal transmitting unit, wherein the instruction signal is transmitted to the governor via the signal receiving unit. The governor is capable of controlling the motor 22 and controlling power of the motor 22 via the output of the governor, such that the rotation speed of the rotor of the motor 22 is controlled. In this way, the propelling speed of the propelling module 10 is controlled. The governor is connected to the external control device in a wireless manner, which is convenient, flexible and easy to control. Meanwhile, the governor has a high speed adjustment efficiency and a wide speed governor range.

The control assembly 21 may be connected to a top portion of the sealed chamber 11. This effectively enhances the connection strength between structures inside the sealed chamber 11. Optionally, the control assembly 21 is connected to the module housing 1 via a fastening screw.

The control assembly 21 may be arranged above the transmission shaft 3. In this way, in the sealed chamber 11, the motor 22 is arranged on a left end portion and the transmission shaft 3 is arranged on a right end portion. The control assembly 21 is arranged above the transmission shaft 3, such that the control assembly 21 occupies a small space, and thus the internal structure of the sealed chamber 11 is compact and reasonable. As such, the entire structure of the propelling module 10 is small, which is easy to transport and greatly reduces transportation and repair costs.

The module housing 1 may include an upper cover 15 and a lower housing 14, wherein the upper cover 15 is connected to a top surface of the lower housing 14. By virtue of the upper cover 15 and the lower housing 14, removing of the rotating device 2 and the transmission shaft 3 inside the sealed chamber 11 is facilitated. Optionally, the upper cover 15 and the lower housing 14 may be connected via a bolt. The sealed chamber 14 is defined between the upper cover 15 and the lower housing 14, and a sealing ring is pressed between the upper cover 14 and the lower housing 14. The sealing ring effectively enhances the sealing performance between the upper cover 15 and the lower housing 14.

The motor 2:2 may be connected to the lower housing 14, and the control assembly 21 may be connected to the upper cover 15. The sealed chamber 11 has a reasonable internal deployment. The control assembly 21 and the motor 22 may be connected via a line joint (not shown in the drawings). By virtue of the line joint, connection between the control assembly 21 and the motor 22 may be conveniently controlled, and removing of the propelling module 10 is facilitated, thereby improving the repair efficiency.

The module housing 1 may be provided with a water inlet 16 and a water outlet 17, wherein the water inlet 16 and the water outlet 17 are both in communication with the sealed chamber 11. The propelling module 10 may further include a cooling tube 6, wherein one end of the cooling tube 6 is connected to the tail end 142 and in communication with the water passage 143, the cooling tube 6 passes through the water inlet 16 and penetrates through the rotating device 2, and the other end of the cooling tube 6 passes through the water outlet 17 and is arranged outside the sealed chamber 11. The water flow in the water passage 143 enters the cooling tube 6 via one end of the cooling tube 6. The cooling tube 6 penetrates through the water inlet 16 such that a portion of the cooling tube 6 is arranged inside the sealed chamber 11. By virtue of the cooling tube 6, heat energy inside the sealed chamber 11 may be effectively removed, thereby lowering the temperature. The cooling tube 6 penetrates through the control assembly 21 and the motor 22 of the rotating device 2, thereby achieving a better heat dissipation effect. The cooling tube 6 penetrates through the water outlet 17, such that the water inside the cooling tube 6 is discharged to the outside of the sealed chamber 11. The module housing 1 may be provided with a tube groove 18, wherein the cooling tube is arranged in the tube groove 18. By connecting the tube groove 18 to the cooling tube, the connection strength between the module housing 1 and the cooling tube 6 is enhanced, and positional shift and backlash of the cooling tube are prevented during use. Optionally, the water inlet of the cooling tube 6 connected to the tail end 142 is arranged behind the propeller 4, that is, the propeller 4 is arranged between the water inlet of the cooling tube 6 and the transmission shaft 3.

A coupling 5 may be arranged between the rotating device 2 and the transmission shaft 3, wherein the coupling 5 has a first rotating shaft 51 and a second rotating shaft 52 having the same rotation axial line. One side of the first rotating shaft 51 is connected to the transmission shaft 3, and the other side of the first rotating shaft 51 is provided with at least one protrusion 511. One side of the second rotating shaft 52 is connected to the rotating device 2, and the other side of the second rotating shaft 52 is arranged to be opposite to the other side of the first rotating shaft 51, and the other side of the second rotating shaft 52 is provided with at least one groove 521, the protrusion 511 inserted into the groove 521. By virtue of coupling 5, mounting precision between the rotating device 2 and the transmission shaft 3 is effectively enhanced, and mounting of the transmission shaft 3 is facilitated.

An elastic member (not shown in the drawings) may be pressed between an outer side wall of the protrusion 511 and an inner side wall of the groove 521. After the protrusion 511 is inserted into the groove 521, a gap is present between the outer side wall of the protrusion 511 and the inner side wall of the groove 521. By pressing an elastic member gap, the first rotating shaft 51 and the second rotating shaft 52 are subject to an elastic force. The elastic member achieves the effects of buffering and shock-absorption, protects the propelling module 10, and thus prolongs the life time of the propelling module 10. Optionally, the elastic member may be made from rubber.

Although the specific embodiments of the present disclosure are described hereinabove, these embodiments are merely illustrated as examples, and the protection scope of the present disclosure is defined by the appended claims. A person skilled in the art may make various variations or modifications to these embodiments without departing from the principle and essence of the present disclosure. However, such variations or modifications shall all fall within the protection scope of the present disclosure.

What is claimed is:

1. A propelling module, comprising: a module housing, a rotating device, a transmission shaft and a propeller; wherein the module housing is provided with a sealed chamber, the propeller is arranged outside the sealed chamber, the rotating device is arranged inside the sealed chamber, one end of the transmission shaft is connected to the rotating device, the other end of the transmission shaft penetrates through a side wall of the sealed chamber and extends to the exterior of the sealed chamber, and the other end of the transmission shaft is connected to the propeller;

the module housing is provided with a power connection member, the rotating device is electrically connected to the power connection member, and the rotating device is configured to be electrically connected to an external device via the power connection member; and the module housing has a storage end and a tail end, wherein the storage end is disposed at a front distal end of the module housing and the tail end is disposed at a rear end of the housing, and wherein the sealed chamber is arranged at the storage end, the module housing is further provided with a water passage, wherein the water passage penetrates through from a bottom surface of the tail end to a side surface of the tail end, and the propeller is arranged in the water passage.

2. The propelling module according to claim 1, wherein the rotating device is electrically connected to an external battery module via the power connection member.

3. The propelling module according to claim 2, wherein the power connection member comprises a connection tube and a connection joint; wherein the connection tube upwardly extends from a top surface at a top portion of the module housing along a vertical direction and the connection tube is in communication with the sealed chamber, the connection joint is sealingly connected in the connection tube and the rotating device is electrically connected to the connection joint, and the connection joint is electrically connected to the external battery module.

4. The propelling module according to claim 1, wherein the rotating device comprises a control assembly and a motor; wherein the control assembly comprises a brushless motor controller, an input of the brushless motor controller is electrically connected to the power connection member, an output of the brushless motor controller is electrically connected to the motor, and the transmission shaft is connected to a rotor of the motor.

5. The propelling module according to claim 4, wherein the control assembly is connected to a top portion of the sealed chamber, and the control assembly is arranged above the transmission shaft.

6. The propelling module according to claim 5, wherein the module housing comprises an upper cover and a lower housing; wherein the upper cover is connected to a top surface of the lower housing, the sealed chamber is defined between the upper cover and the lower housing.

7. The propelling module according to claim 6, wherein the motor is connected to the interior of the housing, the control assembly is connected to the upper cover.

8. The propelling module according to claim 1, wherein a coupling is arranged between the rotating device and the transmission shaft, the coupling comprising a first rotating shaft and a second rotating shaft having the same rotation axial line; wherein one side of the first rotating shaft is connected to the transmission shaft and the other side of the first rotating shaft is provided with at least one protrusion, one side of the second rotating shaft is connected to the rotating device and the other side of the second rotating shaft is arranged to be opposite to the other side of the first rotating shaft, and the other side of the second rotating shaft is provided with at least one groove, the protrusion being inserted into the groove.

9. The propelling module according to claim 8, wherein an elastic member is pressed between an outer side wall of the protrusion and an inner side wall of the groove.

10. The propelling module according to claim 1, wherein the module housing is further provided with a water inlet and a water outlet, wherein the water inlet and the water outlet are both in communication with the sealed chamber; the propelling module further comprises a cooling tube, wherein one end of the cooling tube is connected to the tail end and is in communication with the water passage, the cooling tube passes through the water inlet and penetrates through the rotating device, and the other end of the cooling tube passes through the water outlet and is arranged outside the sealed chamber;

wherein the module housing is further provided with a tube groove, and the cooling tube is arranged in the tube groove.

11. A surfing apparatus, comprising: a surfboard, a battery module and a propelling module as defined in claim 1; wherein the battery module is connected to the surfboard, and the propelling module is detachably connected to the surfboard.

* * * * *